US005434947A

United States Patent [19]

Gerson et al.

[11] Patent Number: 5,434,947

[45] Date of Patent: Jul. 18, 1995

[54] METHOD FOR GENERATING A SPECTRAL NOISE WEIGHTING FILTER FOR USE IN A SPEECH CODER

[75] Inventors: Ira A. Gerson, Schaumburg; Mark A. Jasiuk, Chicago; Matthew A. Hartman, Schaumburg, all of Ill.

[73] Assignee: Motorola, Schaumburg, Ill.

[21] Appl. No.: 21,364

[22] Filed: Feb. 23, 1993

[51] Int. Cl.[6] ..... G10L 9/14

[52] U.S. Cl. ..... 395/2.28; 395/2.36

[58] Field of Search ..... 381/29–40; 395/2.26, 2.3, 2.32, 2.35, 2.31, 2.29, 2.28, 2.36, 2.37; 364/724.01

[56] References Cited

U.S. PATENT DOCUMENTS

| | | | |
|---|---|---|---|
| 4,346,262 | 8/1982 | Willems et al. | 395/2.26 |
| 4,401,855 | 8/1983 | Broderson et al. | 395/2.26 |
| 5,125,030 | 6/1992 | Nomural et al. | 395/2.35 |

OTHER PUBLICATIONS

B. S. Atal, "Predictive Coding of Speech at Low Bit Rtes", IEEE Trans. on Comm., vol. COM-30, No. 4, pp. 600–614, Apr. 1982.

P. Kroon and B. S. Atal, "Strategies for Improving the Performance of CELP Coders at Low Bit Rates", Proc. of Int. Conf. on Acoustics, Speech and Signal Proc., Apr. 1988, pp. 151–154.

J. D. Markel and A. H. Gray, "Linear Prediction of Speech", Springre-Verlang, 1976, pp. 42–59.

*A Low-Delay CELP Coder for the CCITT 16kb/s Speech Coding Standard*, Juin-Hwey Chen, Senior Member, IEEE, Richard V. Cox, Fellow, IEEE, Yen-Chun Lin, Nikil Jayant, Fellow, IEEE, and Melvin J. Melchner, IEEE Journal on Selected Areas in Communications, vol. 10 No. 5, Jun., 1992, pp. 830–849.

*Primary Examiner*—David D. Knepper

*Attorney, Agent, or Firm*—Kirk W. Dailey

[57] ABSTRACT

An Rth-order filter models the frequency response of multiple filters, to provide a filter which offers the control of multiple filters without the complexity of multiple filters. The Rth-order filter can be used as a spectral noise weighting filter or a combination of a short-term predictor filter and a spectral noise weighting filter, referred to as the spectrally noise weighted synthesis filter, depending on which embodiment is employed. In general, the method models the frequency response of L Pth-order filters by a single Rth-order filter, where the order $R<L\times P$. Thus, this method increases the control of a speech coder filter without a corresponding increase in the complexity of the speech coder.

3 Claims, 7 Drawing Sheets

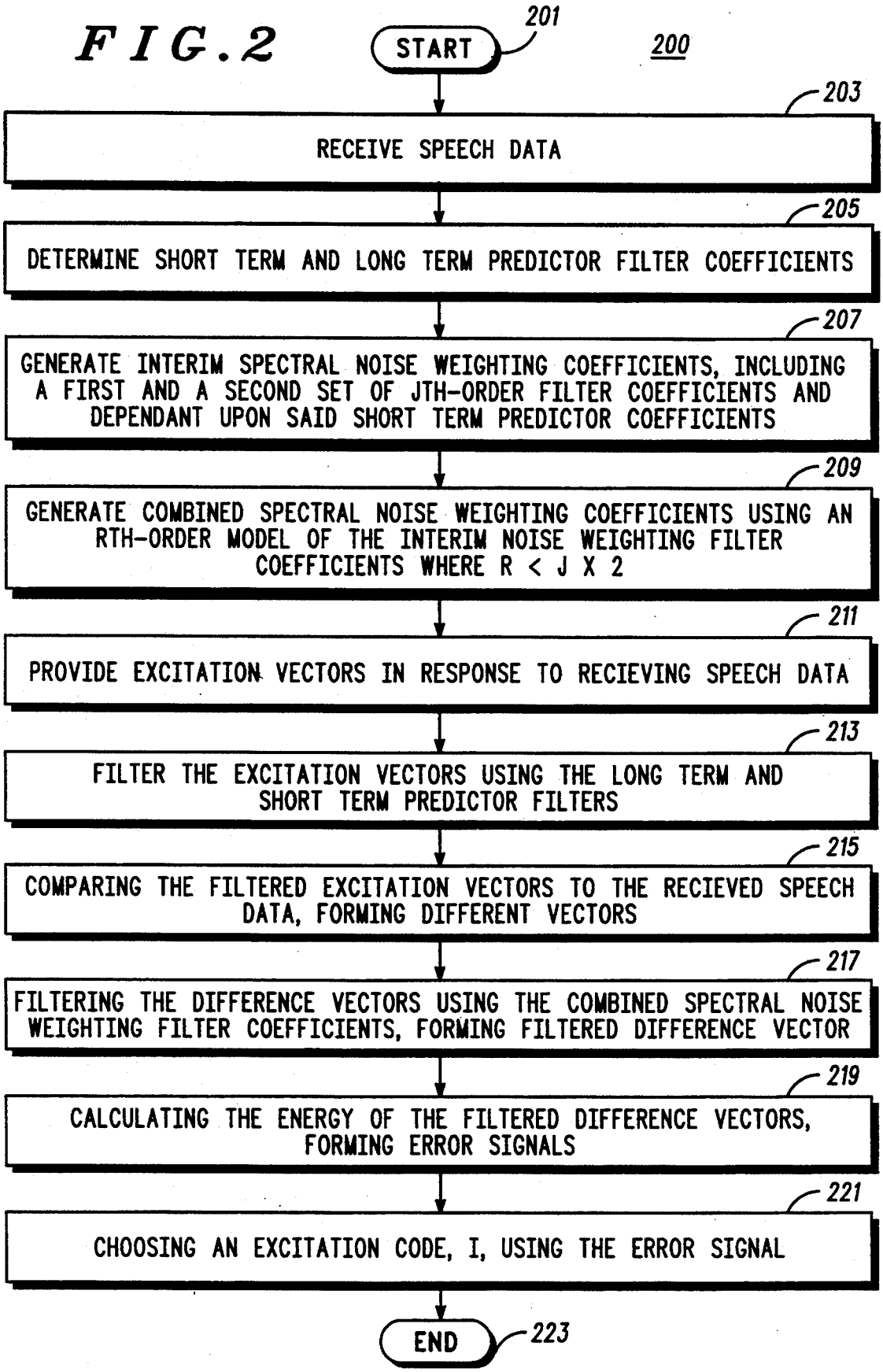
FIG. 2
START
201
200
203
RECEIVE SPEECH DATA
205
DETERMINE SHORT TERM AND LONG TERM PREDICTOR FILTER COEFFICIENTS
207
GENERATE INTERIM SPECTRAL NOISE WEIGHTING COEFFICIENTS, INCLUDING A FIRST AND A SECOND SET OF JTH-ORDER FILTER COEFFICIENTS AND DEPENDANT UPON SAID SHORT TERM PREDICTOR COEFFICIENTS
209
GENERATE COMBINED SPECTRAL NOISE WEIGHTING COEFFICIENTS USING AN RTH-ORDER MODEL OF THE INTERIM NOISE WEIGHTING FILTER COEFFICIENTS WHERE R < J X 2
211
PROVIDE EXCITATION VECTORS IN RESPONSE TO RECIEVING SPEECH DATA
213
FILTER THE EXCITATION VECTORS USING THE LONG TERM AND SHORT TERM PREDICTOR FILTERS
215
COMPARING THE FILTERED EXCITATION VECTORS TO THE RECIEVED SPEECH DATA, FORMING DIFFERENT VECTORS
217
FILTERING THE DIFFERENCE VECTORS USING THE COMBINED SPECTRAL NOISE WEIGHTING FILTER COEFFICIENTS, FORMING FILTERED DIFFERENCE VECTOR
219
CALCULATING THE ENERGY OF THE FILTERED DIFFERENCE VECTORS, FORMING ERROR SIGNALS
221
CHOOSING AN EXCITATION CODE, I, USING THE ERROR SIGNAL
END
223

FIG. 6A CONFIGURATION 1
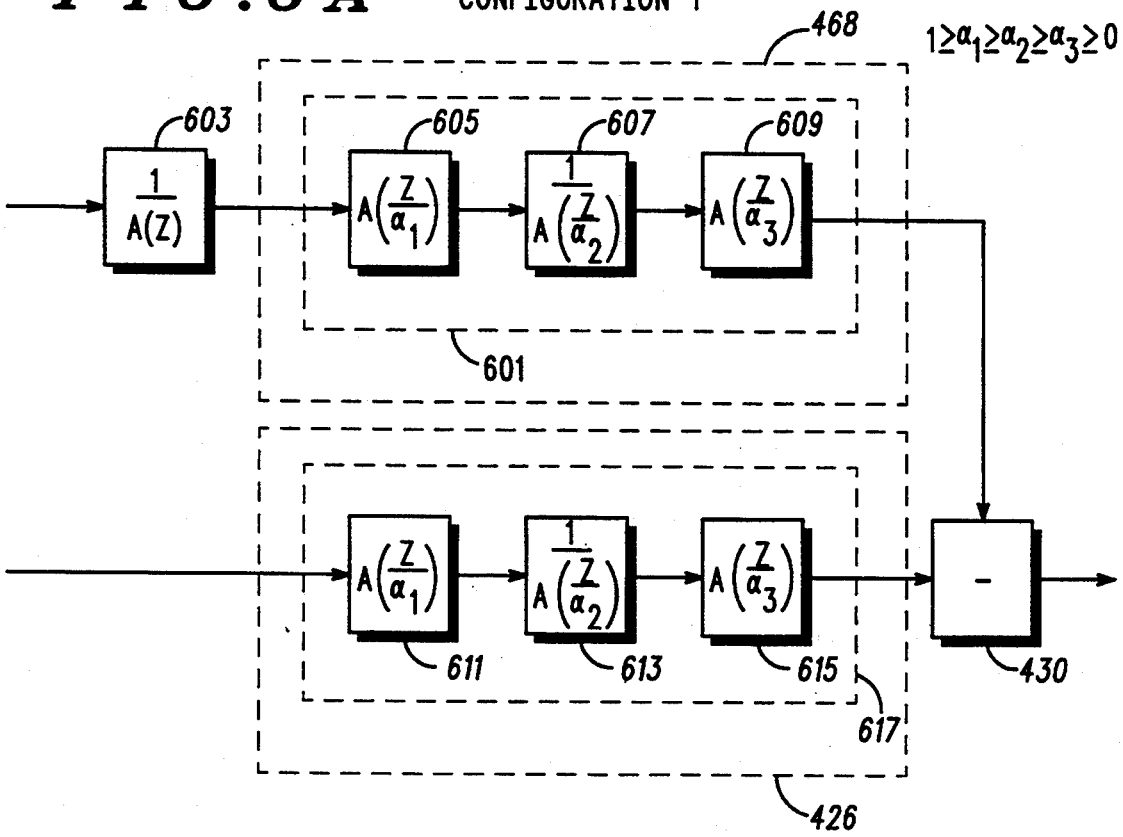
FIG. 6B CONFIGURATION 2
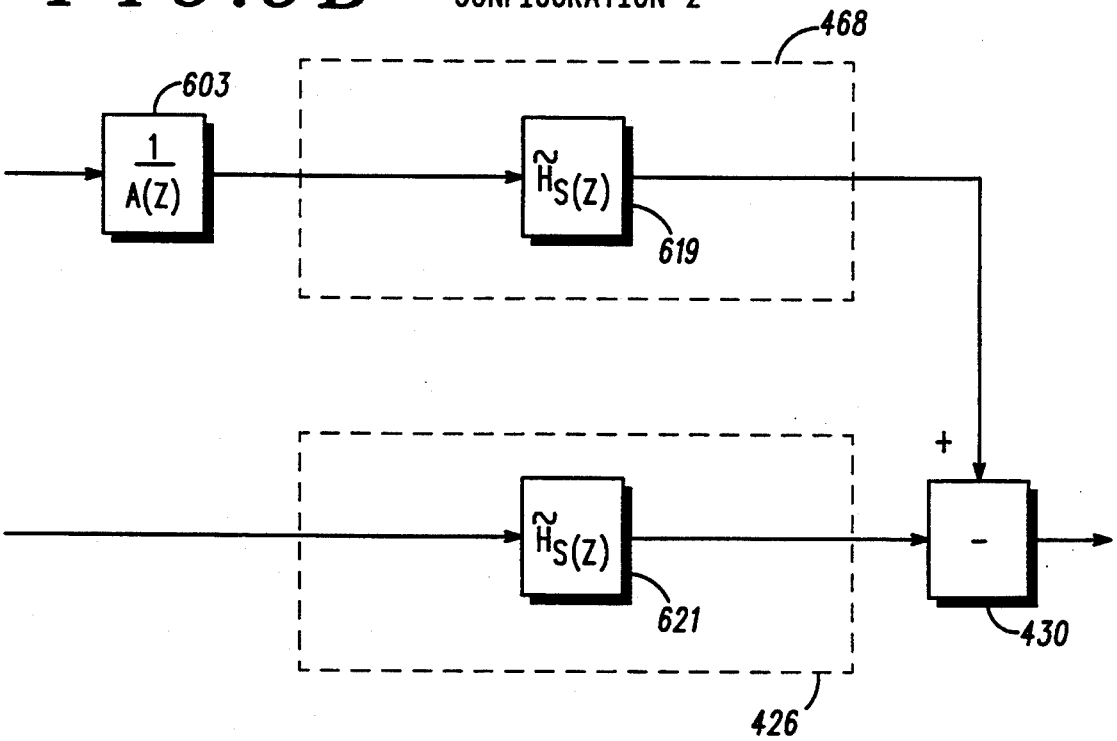

METHOD FOR GENERATING A SPECTRAL NOISE WEIGHTING FILTER FOR USE IN A SPEECH CODER

FIELD OF THE INVENTION

The present invention generally relates to speech coding, and more particularly, to an improved method of generating a spectral noise weighting filter for use in a speech coder.

BACKGROUND OF THE INVENTION

Code-excited linear prediction (CELP) is a speech coding technique used to produce high quality synthesized speech. This class of speech coding, also known as vector-exalted linear prediction, is used in numerous speech communication and speech synthesis applications. CELP is particularly applicable to digital speech encryption and digital radiotelephone communications systems wherein speech quality, data rate, size and cost are significant issues.

In a CELP speech coder, the long-term (pitch) and the short-term (formant) predictors which model the characteristics of the input speech signal are incorporated in a set of time varying filters. Namely, a long-term and a short-term filter. An excitation signal for the filters is chosen from a codebook of stored innovation sequences, or codevectors.

For each frame of speech, the speech coder applies an individual codevector to the filters to generate a reconstructed speech signal. The reconstructed speech signal is compared to the original input speech signal, creating an error signal. The error signal is then weighted by passing it through a spectral noise weighting filter having a response based on human auditory perception. The optimum excitation signal is determined by selecting a codevector which produces the weighted error signal with the minimum energy for the current frame of speech.

For each speech frame a set of linear predictive coding parameters are produced by a coefficient analyzer. The parameters typically include coefficients for the long term, short term and spectral noise weighting filters.

The filtering operations due to a spectral noise weighting filter can constitute a significant portion of a speech coder's overall computational complexity, since a spectrally weighted error signal needs to be computed for each codevector from a codebook of innovation sequences. Typically a compromise between the control afforded by and the complexity due to the spectral noise weighting filter needs to be reached. A technique which would allow an increased control of the frequency shaping introduced by the spectral noise weighting filter, without a corresponding increase in weighting filter complexity, would be a useful advance in the state of the art of speech coding.

BRIEF DESCRIPTION OF THE DRAWINGS

FIG. 2 is a process flow chart illustrating the general sequence of speech coding operations performed in accordance with an embodiment of the present invention.

FIG. 6 is a block diagram of particular spectral noise weighting filter configurations in accordance with the present invention.

DETAILED DESCRIPTION OF THE PREFERRED EMBODIMENT

This disclosure encompasses a digital speech coding method. This method includes modeling the frequency response of multiple filters by an Rth-order filter, thereby providing a filter which offers the control of multiple filters without the complexity of multiple filters. The Rth-order filter can be used as a spectral noise weighting filter or a combination of a short-term predictor filter and a spectral noise weighting filter, depending on which embodiment is employed. The combination of the short-term predictor filter and the spectral noise weighting filter is referred to as the spectrally noise weighted synthesis filter. In general, the method models the frequency response of L P-th order filters by a single R-th order filter, where $R<L\times P$. In the preferred embodiment, L equals 2. The following equation illustrates the method employed in the present invention.

$$\frac{1}{A\left[\frac{z}{\alpha_2}\right]} A\left[\frac{z}{\alpha_3}\right] \Rightarrow \frac{1}{1-\sum_{i=1}^{R} \bar{a}_i z^{-i}} \text{. where}$$

$$A\left(\frac{z}{\alpha_n}\right) = \frac{1}{1-\sum_{i=1}^{P} a_i \alpha_n^i z^{-i}}.$$

Figure 1:
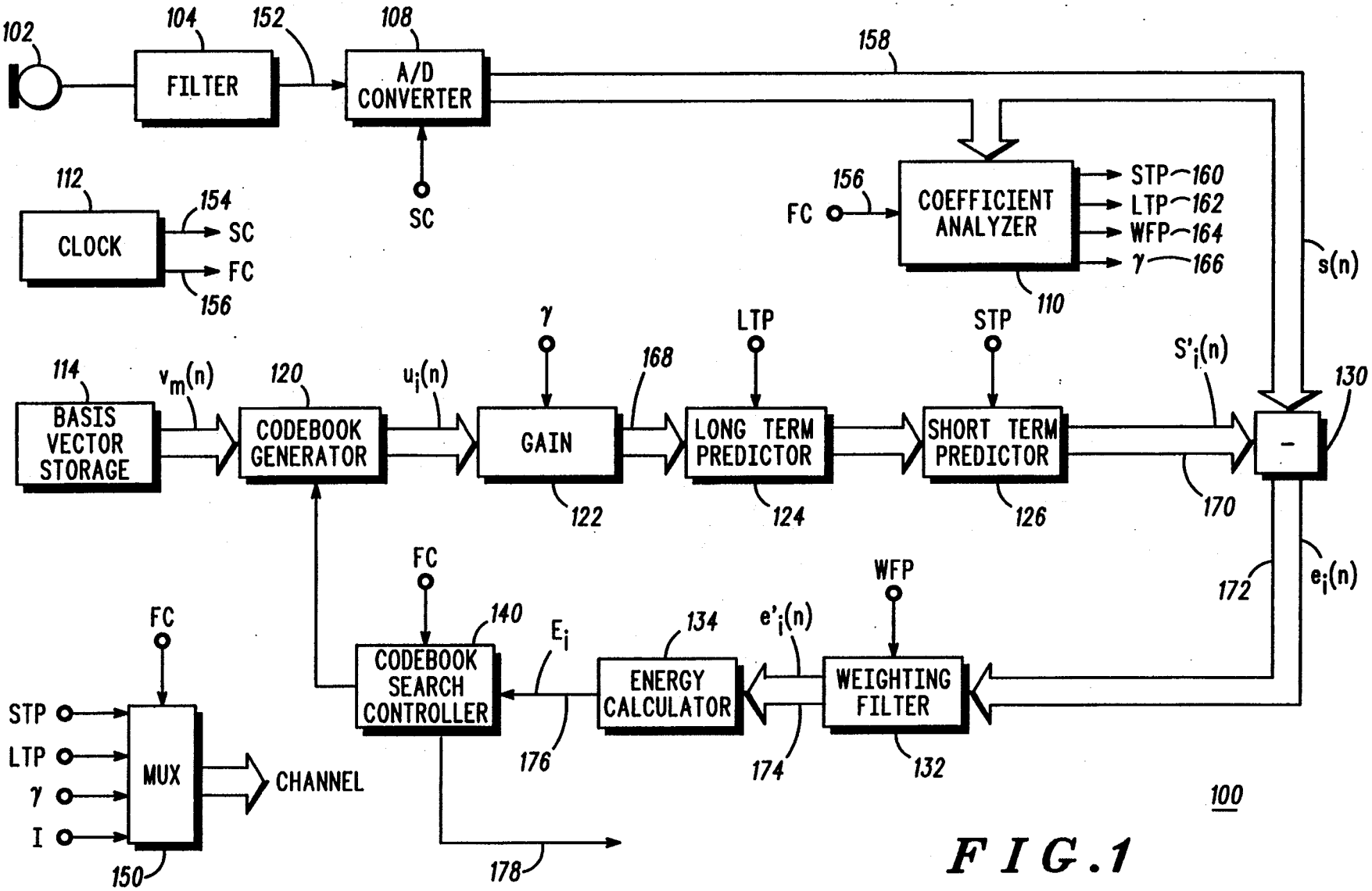
FIG. 1 is a a block diagram of a speech coder in which the present invention may be employed.

FIG. 1 is a block diagram of a first embodiment of a speech coder employing the present invention. An acoustic input signal to be analyzed is applied to speech coder 100 at microphone 102. The input signal, typically a speech signal, is then applied to filter 104. Filter 104 generally will exhibit bandpass filter characteristics. However, if the speech bandwidth is already adequate, filter 104 may comprise a direct wire connection.

An analog-to-digital (A/D) convertor 108 converts the analog speech signal 152 output from filter 104 into a sequence of N pulse samples, the amplitude of each pulse sample is then represented by a digital code, as is known in the art. The sample clock, SC, determines the sampling rate of the A/D converter 108. In the preferred embodiment, SC is run at 8 KHz. The sample clock SC is generated along with the frame clock FC in the clock module 112.

The digital output of A/D 108, referred to as input speech vector, s(n) 158, is applied to coefficient analyzer 110. This input speech vector s(n) 158 is repetitively obtained in separate frames, i.e., lengths of time, the length of which is determined by the frame clock FC.

For each block of speech, a set of linear predictive coding (LPC) parameters is produced by coefficient analyzer 110. The short term predictor coefficients 160 (STP), long term predictor coefficients 162 (LTP), and excitation gain factor 166 $\gamma$ are applied to multiplexer 150 and sent over the channel for use by the speech synthesizer. The input speech vector, s(n), 158 is also applied to subtracter 130, the function of which will subsequently be described.

Basis vector storage block 114 contains a set of M basis vectors $V_m(n)$, wherein $1 \leqq m \leqq M$, each comprised of N samples, wherein $1 \leqq n \leqq N$. These basis vectors are used by codebook generator 120 to generate a set of $2^M$ pseudo-random excitation vectors $u_i(n)$, wherein $0 \leqq i \leqq 2^M-1$. Each of the M basis vectors are comprised of a series of random white Guassian samples, although other types of basis vectors may be used.

Codebook generator 120 utilizes the M basis vectors $V_m(n)$ and a set of $2^M$ excitation codewords $I_i$, where $0 \leqq i \leqq 2^M-1$, to generate the $2^M$ excitation vectors $u_i(n)$. In the present embodiment, each codeword $I_i$ is equal to its index i, that is, $I_i=i$. If the excitation signal were coded at a rate of 0.25 bits per sample for each of the 40 samples (such that M=10), then there would be 10 basis vectors used to generate the 1024 excitation vectors.

For each individual excitation vector $u_i(n)$, a reconstructed speech vector $s'_i(n)$ is generated for comparison to the input speech vector s(n). Gain block 122 scales the excitation vector $u_i(n)$ by the excitation gain factor $\gamma_i$, which is constant for the frame. The scaled excitation signal $\gamma_i u_i(n)$ 168 is then filtered by long term predictor filter 124 and short term predictor filter 126 to generate the reconstructed speech vector $s'_i(n)$ 170. Long term predictor filter 124 utilizes the long term predictor coefficients 162 to introduce voice periodicity, and short term predictor filter 126 utilizes the short term predictor coefficients 160 to introduce the spectral envelope. Note that blocks 124 and 126 are actually recursive filters which contain the long term predictor and short term predictor in their respective feedback paths.

The reconstructed speech vector $s'_i(n)$ 170 for the i-th excitation codevector is compared to the same block of the input speech vector s(n) 158 by subtracting these two signals in subtracter 130. The difference vector $e_i(n)$ 172 represents the difference between the original and the reconstructed blocks of speech. The difference vector $e_i(n)$ 172 is weighted by the spectral noise weighting filter 132, utilizing the spectral noise weighting filter coefficients 164 generated by coefficient analyzer 110. Spectral noise weighting accentuates those frequencies where the error is perceptually more important to the human ear, and attenuates other frequencies. A more efficient method of performing the spectral noise weighting is the subject of this invention.

Energy calculator 134 computes the energy of the spectrally noise weighted difference vector $e'_i(n)$ 174, and applies this error signal $E_i$ 176 to codebook search controller 140. The codebook search controller 140 compares the i-th error signal for the present excitation vector $u_i(n)$ against previous error signals to determine the excitation vector producing the minimum weighted error. The code of the i-th excitation vector having a minimum error is then output over the channel as the best excitation code I 178. In the alternative, search controller 140 may determine a particular codeword which provides an error signal having some predetermined criteria, such as meeting a predefined error threshold.

FIG. 2 contains process flow chart 200 illustrating the general sequence of speech coding operations performed in accordance with the first embodiment of the present invention illustrated in FIG. 1. The process begins at 201. Function block 203, receives speech data in accordance with the description of FIG. 1. Function block 205 determines the short term and the long term predictor coefficients. This is carried out in the coefficient analyzer 110 of FIG. 1. Methods for determining the short term and long term predictor coefficients are contained in the article entitled, "Predictive Coding of Speech at Low Bit Rates," IEEE Trans. Commun. Vol. Com-30, pp. 600–14, April 1982, by B. S. Atal. The short term predictor, A(z), is defined by the coefficients of the equation $$A(z) = \frac{1}{1 - \sum_{i=1}^{P} a_i z^{-i}}.$$

Function block 207 generates a set of interim spectral noise weighting filter coefficients which characterize at least a first and second set of filters. The filters can be any-order filters, i.e. the first filter is F-order and the second filter is Jth-order, where R<F+J. The preferred embodiment uses two Jth-order filters, wherein J is equal to P. The filters using these coefficients are of the form $$\hat{H}(z) = \frac{1}{A\left[\frac{z}{\alpha_2}\right]} A\left[\frac{z}{\alpha_3}\right] \text{where } 1 \geqq \alpha_2 \geqq \alpha_3 \geqq 0.$$

$\hat{H}(z)$, which is a cascade of at least a first and second set of Jth-order filters, is defined as the interim spectral noise weighting filter. Note that the coefficients of the interim spectral noise weighting filter are dependent upon the short term predictor coefficients generated at function block 205. This interim spectral noise weighting filter, $\hat{H}(z)$, has been used directly in speech coder implementations in the past.

To reduce the computational complexity due to spectral noise weighting, the frequency response of $\hat{H}(z)$ is modeled by a single Rth-order filter $\hat{H}_s(z)$, which is the combined spectral noise weighting filter, of the form:

$$\hat{H}_s(z) = \frac{1}{1 - \sum_{i=1}^{R} \bar{a}_i z^{-i}}.$$

Note that although $\hat{H}_s(z)$ is shown as a pole filter, $\hat{H}_s(z)$ may also be designed to be a zero filter. Function block 209 generates the $\hat{H}_s(z)$ filter coefficients. The process of generating the coefficients for the combined spectral noise weighting filter is illustrated in detail in FIG. 3. Note that the Rth-order all-pole model is of a lower order than the interim spectral noise weighting filter, which leads to computational savings.

Function block 211 provides excitation vectors in response to receiving speech data in accordance with the description of FIG. 1. Function block 213 filters the excitation vectors through the long term 124 and short term 126 predictor filters.

Function block 215 compares the filtered excitation vectors output from function block 213 and in accordance with the description of FIG. 1 forms a difference vector. Function block 217 filters the difference vector, using the combined spectral noise weighting filter coefficients generated at function block 209, to form a spectral noise weighted difference vector. Function block 219 calculates the energy of the spectral noise weighted difference vector in accordance with the description of FIG. I and forms an error signal. Function block 221 chooses an excitation code, I, using the error signal in accordance with the description of FIG. 1. The process ends at 223.

Figure 3:
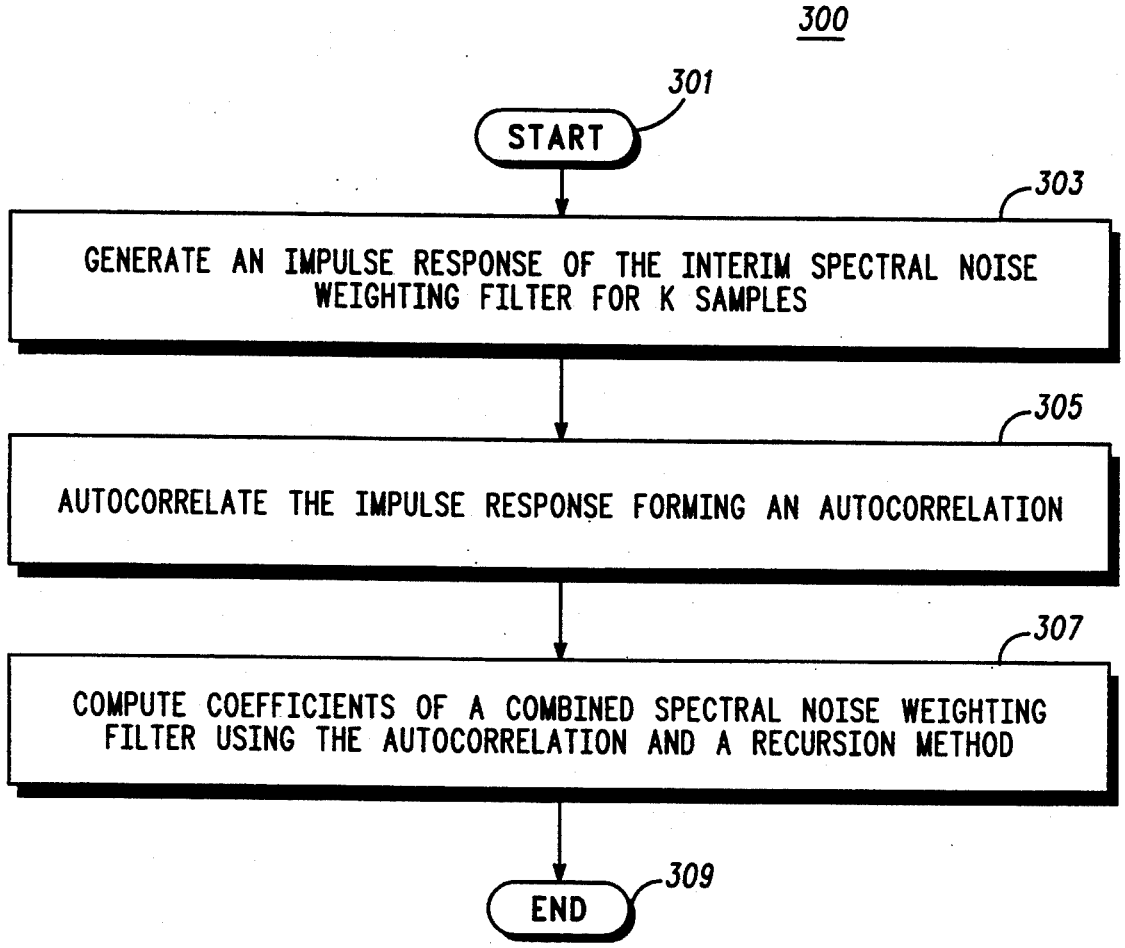
FIG. 3 is a process flow chart illustrating the sequence of generating combined spectral noise filter coefficients in accordance with the present invention.

FIG. 3 is an illustration of the process flow chart 300 describing the details which may be employed in implementing function block 209 of FIG. 2. The process begins at 301. Given the interim spectral noise weighting filter, $\hat{H}(z)$, function block 303 generates an impulse response, $\hat{h}(n)$, of $\hat{H}(z)$ for K samples, where $$\hat{H}(z) = A\left[\frac{z}{\alpha_1}\right]\frac{1}{A\left[\frac{z}{\alpha_2}\right]}A\left[\frac{z}{\alpha_3}\right] \text{where } 0 \leqq \alpha_n \leqq 1,$$

$$A\left(\frac{z}{\alpha_n}\right) = \frac{1}{1 - \sum_{i=1}^{P} a_i\alpha_n^i z^{-i}}$$

and there are at least two non-cancelling terms; i.e., that is $\alpha_1 \neq \alpha_2$ with $\alpha_1 > 0$ and $\alpha_2 > 0$, or $\alpha_2 \neq \alpha_3$ with $\alpha_2 > 0$ and $\alpha_3 > 0$. Function block 305 auto-correlates the impulse response $\hat{h}(n)$ forming an auto-con-elation of the form $$R_{hh}(i) = \sum_{n=1}^{K-i} \hat{h}(n)\hat{h}(n+i),\ 0 \leqq i \leqq R;\ R < K$$

Function block 307 computes, using the auto-correlation and Levinson's recursion, the coefficients of $\hat{H}_s(z)$, which is the combined spectral noise weighting filter, of the form:

$$\hat{H}_s(z) = \frac{1}{1 - \sum_{i=1}^{R} a_i z^{-i}}.$$

Figure 4:
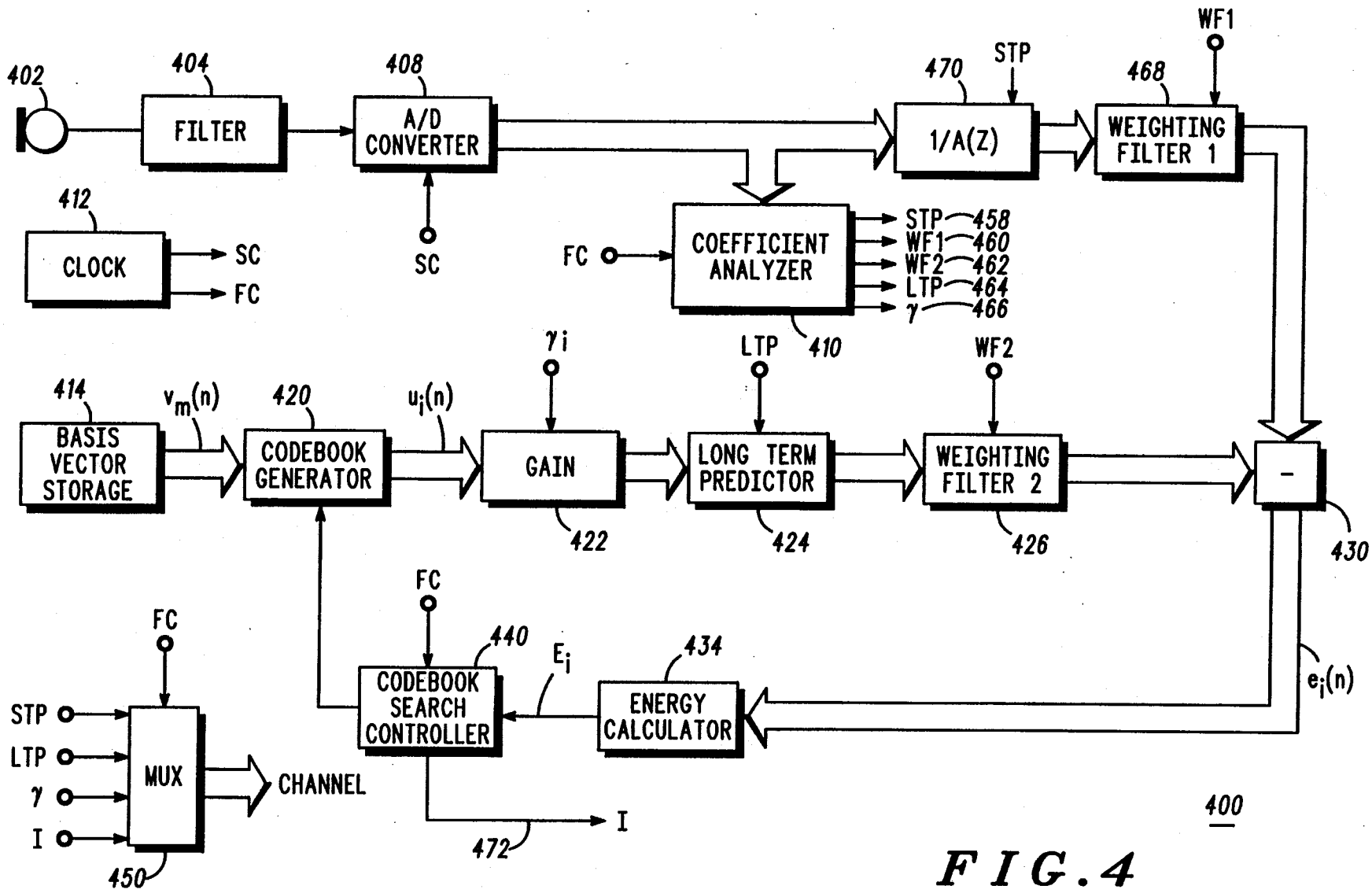
FIG. 4 is a block diagram of an embodiment of a speech coder in accordance with the present invention.

FIG. 4 is a generic block diagram of a second embodiment of a speech coder in accordance with the present invention. Speech coder 400 is similar to speech coder 100 except for the differences explained below. First, the spectral noise weighting filter 132 of FIG. 1 is replaced by two filters which precede the subtracter 430 in FIG. 4. Those two filters are the spectrally noise weighted synthesis filter 468 and spectrally noise weighted synthesis filter2 426. Hereinafter, these filters are referred to as filter1 and filter2 respectively. Filter1 468 and filter2 426 differ from the spectral noise weighting filter 132 of FIG. 1 in that each includes a short term synthesis filter or a weighted short term synthesis filter, in addition to a spectral noise weighting filter. The resulting filter is generically referred to as a spectrally noise weighted synthesis filter. Specifically, it may be implemented as the interim spectrally noise weighted synthesis filter or as a combined spectrally noise weighted synthesis filter. Filter1 468 is preceded by a short term inverse filter 470. Additionally, the short term predictor 126 of FIG. I has been eliminated in FIG. 4. Filter1 and filter2 are identical except for their respective locations in FIG. 4. Two specific configurations of these filters are illustrated in FIG. 6 and FIG. 7.

Figure 5:
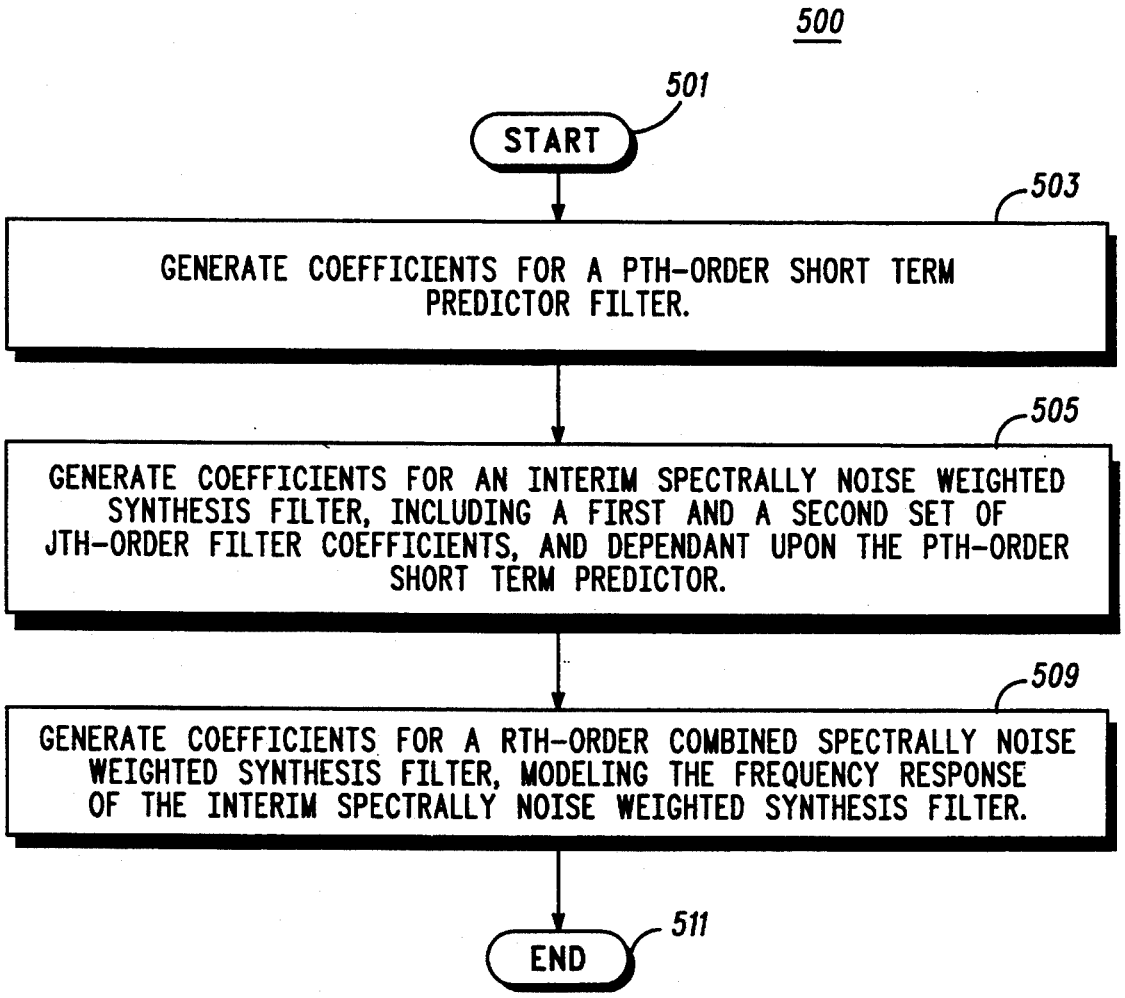
FIG. 5 is a process flow chart illustrating the general sequence of speech coding operations performed in accordance with an embodiment of the present invention.

Coefficient analyzer 410 generates short term predictor coefficients 458, filter1 coefficients 460, filter2 coefficients 462, long term predictor coefficients 464 and excitation gain factor $\gamma$ 466. The method of generating the coefficients for filter1 and filter2 is illustrated in FIG. 5. Speech coder 400 can produce the same results as speech coder 100 while potentially reducing the number of necessary calculations. Thus, speech coder 400 may be preferable to speech coder 100. The description of those function blocks identical in both speech coder 100 and speech coder 400 will not be repeated for the sake of efficiency.

FIG. 5 is a process flowchart illustrating the method of generating the coefficients for $\tilde{H}_s(z)$, which is the combined spectrally noise weighted synthesis filter. The process begins at 501. Function block 503 generates the coefficients for a Pth-order short term predictor filter, A(z). Function block 505 generates coefficients for an interim spectrally noise weighted synthesis filter, $\tilde{H}(z)$, of the form $$\tilde{H}(z) = A\left[\frac{z}{\alpha_1}\right]\frac{1}{A\left[\frac{z}{\alpha_2}\right]}A\left[\frac{z}{\alpha_3}\right] \text{where } 0 \leqq \alpha_n \leqq 1,$$

$$A\left(\frac{z}{\alpha_n}\right) = \frac{1}{1 - \sum_{i=1}^{P} a_i\alpha_n^i z^{-i}}.$$

Given $\tilde{H}(z)$, function block 509 generates coefficients for an Rth-order combined spectrally noise weighted synthesis filter, $\tilde{H}_s(z)$, which models the frequency response of filter $\tilde{H}(z)$. The coefficients are generated by autocorrelating the impulse response, $\tilde{h}(n)$, of $\tilde{H}(z)$ and using a recursion method to find the coefficients. The preferred embodiment uses Levinson's recursion which is presumed known by one of average skill in the art. The process ends at 511.

FIG. 6 and FIG. 7 show the first configuration and the second configuration respectively which may be employed in weighted synthesis filter1 468 and weighted synthesis filter2 426 of FIG. 4.

In configuration 1, FIG. 6*a*, the weighted synthesis filter2 426 contains the interim spectrally noise weighed synthesis filter $\tilde{H}(z)$, which is a cascade of three filters: the short term synthesis filter weighted by $\alpha_1$, $A(z/\alpha_1)$ 611, the short term inverse filter weighted by $\alpha_2$, $1/A(z/\alpha_2)$ 613, and the short term synthesis filter weighted by $\alpha_3$, $A(z/\alpha_3)$ 615, where $0 \leqq \alpha_3 \leqq \alpha_2 \leqq \alpha_1 \leqq 1$. Weighted synthesis filter1 468, FIG. 6*a*, is identical to weighted synthesis filter2 426, except that it is preceded by a short term inverse filter $1/A(z)$ 603, and is placed in the input speech path. $\tilde{H}(z)$ is in that case a cascade of filters 605, 607, and 609.

In FIG. 6*b*, the interim spectrally noise weighted synthesis filter $\tilde{H}(z)$ 468 and 426, is replaced by a single combined spectrally noise weighted synthesis filter $\tilde{H}_s(z)$ 619 and 621. $\tilde{H}_s(z)$ models the frequency response of $\tilde{H}(z)$, which is a cascade of filters 605, 607, and 609, or equivalently a cascade of filters 611, 613, and 615, FIG. 6*a*. The details of generating the $\tilde{H}_s(z)$ filter coefficients are found in FIG. 5.

Figure 7A:
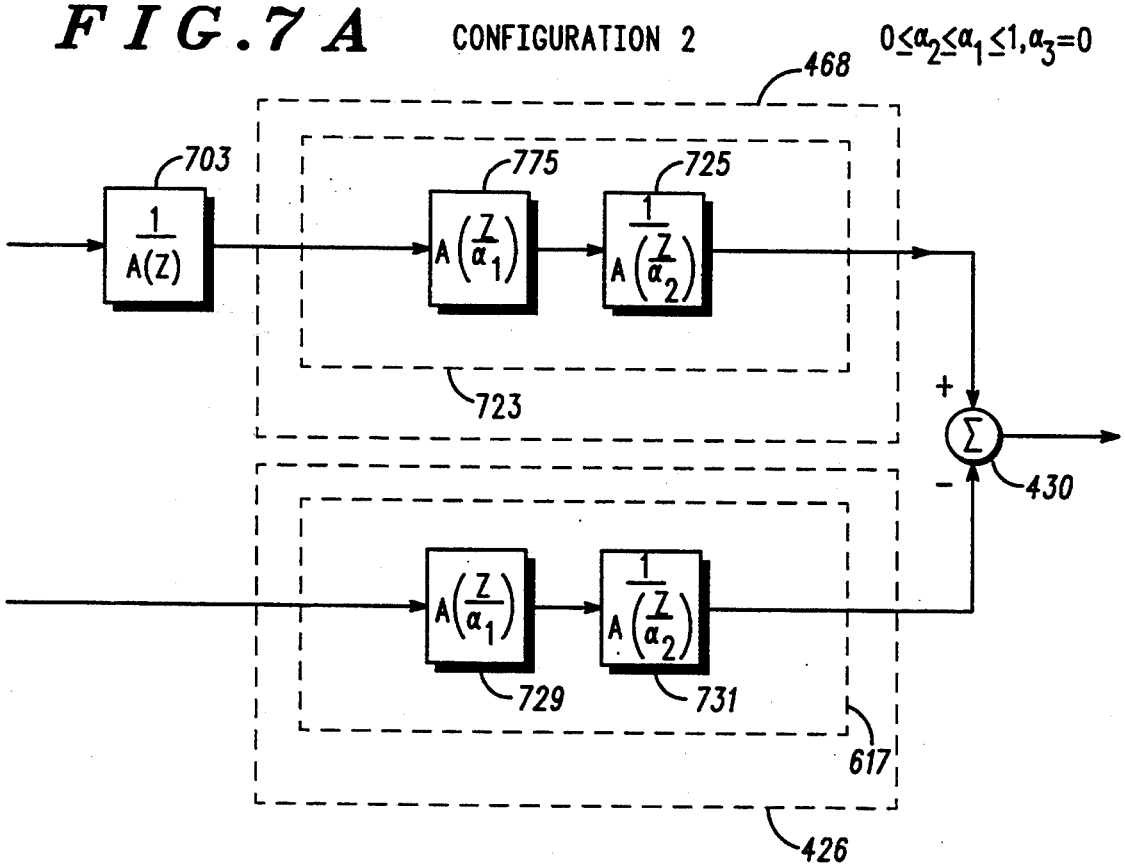
FIG. 7 is a block diagram of particular spectral noise weighing filter configurations in accordance with the present invention.

Configuration 2, FIG. 7*a*, is a special case of configuration 1, where $\alpha_3=0$. The weighted synthesis filter2 426 contains the interim spectrally noise weighted synthesis filter, $\tilde{H}(z)$, which is a cascade of two filters: the short term synthesis filter weighted by $\alpha_1$, $A(z/\alpha_1)$ 729, and the short term inverse filter weighted by $\alpha_2$, $1/A(z/\alpha_2)$ 731. The weighted synthesis filter1 468, FIG. 7*a*, is identical to weighted synthesis filter2 426, except that it is preceded by a short term inverse filter $1/A(z)$ 703, and is placed in the input speech path. $\tilde{H}(z)$ is in that case a cascade of filters 725 and 727.

Figure 7B:
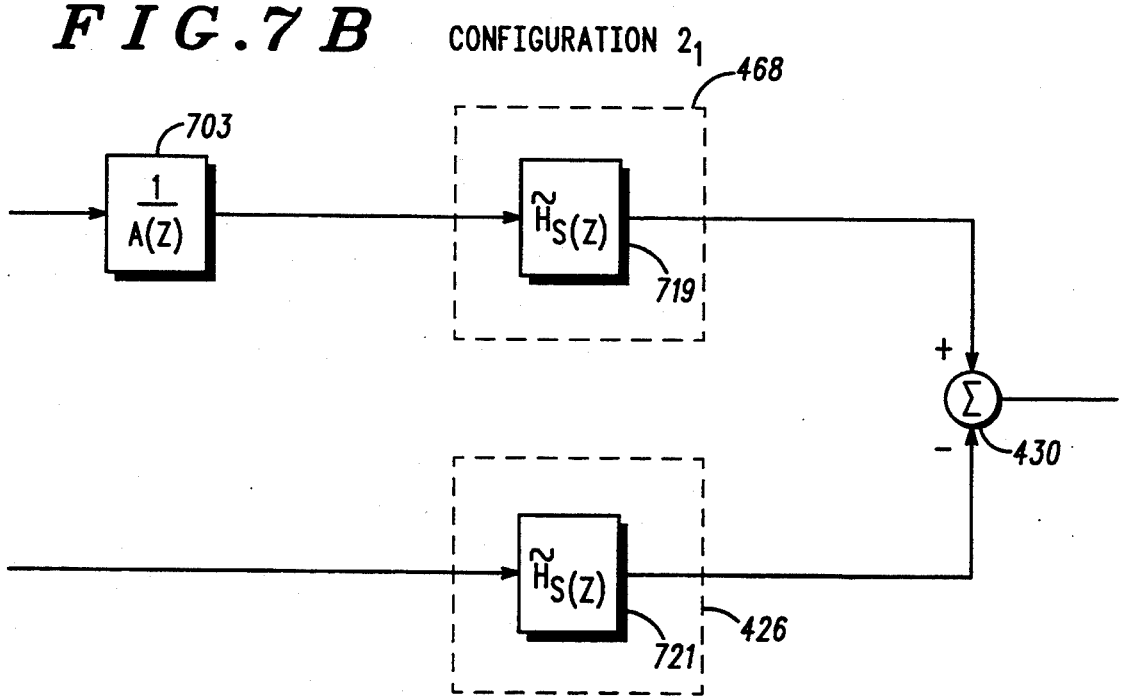

In FIG. 7*b*, the interim spectrally noise weighted synthesis filter $\tilde{H}(z)$ 468 and 426, FIG. 7*a*, is replaced by a single combined spectrally noise weighted synthesis filter $\tilde{H}_s(z)$ 719 and 721. $\tilde{H}_s(z)$ models the frequency response of $\tilde{H}(z)$, which is a cascade of filters 725 and 727, or equivalently a cascade of filters 729 and 731, FIG. 7*a*. The details of generating the $\tilde{H}_s(z)$ filter coefficients are found in FIG. 5.

Generating the combined spectral noise weighting filter from the interim spectral noise weighting filter of the form disclosed herein, creates an efficient filter having the control of 2 or more Jth-order filters with the complexity of one Rth-order filter. This provides a more efficient filter without a corresponding increase in the complexity of the speech coder. Likewise, generating the combined spectrally noise weighted synthesis filter from the interim spectrally noise weighted synthesis filter of the form disclosed herein, creates an efficient filter having the control of one Pth-order filter and one or more Jth-order filters combined into one Rth-order filter. This provides a more efficient filter without a corresponding increase in the complexity of the speech coder.

What is claimed is:

1. A method of speech coding comprising the steps of:

receiving speech data;

providing excitation vectors;

generating filter coefficients for a combined short term and spectral noise weighting filter comprising the steps of:

generating a Pth-order short term filter;

generating an interim spectral noise weighting filter including a first F-order filter and a second Jth-order filter, each filter dependent upon said Pth-order short term filter, and generating coefficients for a Rth-order all-pole combined short term and spectral noise weighting filter using said Pth-order short term filter and said interim spectral noise weighting filter, where $R<P+F+J$;

filtering said received speech data;

filtering said excitation vectors utilizing a long term predictor filter and said combined short term and spectral noise weighting filter, forming filtered excitation vectors;

comparing said filtered excitation vectors to said filtered received speech data, forming a difference vector;

calculating energy of said difference vector, forming an error signal; and choosing, using the error signal, an excitation code, I, representing the received speech data.

2. A method of speech coding comprising the steps of:

receiving speech data;

providing excitation vectors in response to said step of receiving;

determining short term and long term predictor coefficients for use by a long term and a Pth-order short term predictor filter;

filtering said excitation vectors utilizing said long term predictor filter and said short term predictor filter, forming filtered excitation vectors;

determining coefficients for a spectral noise weighting filter comprising the step of:

generating an interim spectral noise weighting filter including a first F-order filter and a second Jth-order filter, dependent upon said Pth-order short term filter coefficients, and generating spectral noise weighting coefficients using a Rth-order all-pole model of said interim spectral noise weighting filter, where $R<F+J$;

comparing said filtered excitation vectors to said received speech data, forming a difference vector;

filtering said difference vector using a filter dependent upon said spectral noise weighting filter coefficients, forming a filtered difference vector;

calculating energy of said filtered difference vector, forming an error signal; and choosing an excitation code, I, using the error signal, which represents the received speech data.

3. A method of speech coding in accordance with claim 2 wherein said step of generating coefficients for a Rth-order all-pole combined short term and spectral noise weighting filter further comprises the steps of:

generating the impulse response of the interim spectral noise weighting filter;

autocorrelating said impulse response, forming an autocorrelation $R_{hh}(i)$; and computing the coefficients of the Rth-order all-pole filter using a method of recursion and the autocorrelation.

* * * * *